US005452398A

United States Patent [19]

Yamada et al.

[11] Patent Number: 5,452,398

[45] Date of Patent: Sep. 19, 1995

[54] SPEECH ANALYSIS METHOD AND DEVICE FOR SUPPYLING DATA TO SYNTHESIZE SPEECH WITH DIMINISHED SPECTRAL DISTORTION AT THE TIME OF PITCH CHANGE

[75] Inventors: Keiichi Yamada, Kanagawa; Naoto Iwahashi, Nara, both of Japan

[73] Assignee: Sony Corporation, Tokyo, Japan

[21] Appl. No.: 56,416

[22] Filed: May 3, 1993

[30] Foreign Application Priority Data

May 1, 1992 [JP] Japan ..... 4-112627

[51] Int. Cl.[6] ..... G10L 9/00

[52] U.S. Cl. ..... 395/232; 381/5.1; 395/2.3; 395/2.67; 395/2.12

[58] Field of Search ..... 364/487; 381/36, 38, 381/51; 395/2, 2.1, 2.3, 2.32, 2.12–2.16, 2.67

[56] References Cited

U.S. PATENT DOCUMENTS

| | | | |
|---|---|---|---|
| 4,559,602 | 12/1985 | Bates, Jr. | 364/487 |
| 4,817,155 | 3/1989 | Briar et al. | 395/2.12 |
| 4,850,022 | 7/1989 | Honda et al. | 395/2.16 |
| 4,937,868 | 6/1990 | Taguchi | 381/38 |
| 5,029,211 | 7/1991 | Ozawa | 381/36 |
| 5,091,946 | 2/1992 | Ozawa | 381/36 |
| 5,133,449 | 5/1992 | Blanton et al. | 381/51 |
| 5,179,626 | 1/1993 | Thomson | 395/2 |
| 5,293,449 | 3/1994 | Tzeng | 395/2.32 |
| 5,327,518 | 7/1994 | George et al. | 395/2.2 |

*Primary Examiner*—Allen R. MacDonald
*Assistant Examiner*—Taviq Hafiz
*Attorney, Agent, or Firm*—Jay H. Maioli

[57] ABSTRACT

A method for speech analysis applicable to a speech analysis/synthesis system employed for producing a synthetic speech. Voiced and unvoiced segments of input speech signals X(n) are discriminated. An amplitude information $A(\omega)$ and a phase information $P_X(\omega)$ are extracted from the voiced segments of the input speech signals. A pitch period is detected from the voiced segments of the input speech signals. A pulse train S(n) as a sound source information is generated so that its period corresponds on the time scale to the detected pitch period of the input speech signals. A phase information $P_S(\omega)$ is extracted from the pulse train S(n). A difference $P(\omega)$ between the phase information $P_S(\omega)$ of the pulse train S(n) and the phase information $P_X(\omega)$ of the input speech signal is found and is supplied as the phase information of the desired one-pitch period within the input speech signals.

9 Claims, 4 Drawing Sheets

SPEECH ANALYSIS METHOD AND DEVICE FOR SUPPYLING DATA TO SYNTHESIZE SPEECH WITH DIMINISHED SPECTRAL DISTORTION AT THE TIME OF PITCH CHANGE

BACKGROUND OF THE INVENTION

This invention relates to a speech analysis method applicable to a speech analysis/synthesis system employed for producing a synthetic sound.

The human auditory sense is a kind of a spectrum analyzer and has such characteristics that, if the power spectrum of plural sounds is the same, the sounds are heard plural as the recognized same sound. These characteristics are utilized in producing the sound by the speech analysis/synthesis method.

For producing synthetic speech, input signals are analyzed by a speech analyzer to extract or detect pitch data, voiced/unvoiced decision data, amplitude data, etc., and the sound is artificially produced by a speech synthesizer based on these data. Above all, the speech synthesis system is classified, according to the method of synthesis, into a speech editing system, parametric synthesis system and a rule synthesizing system.

With the speech editing system, the waveform of a speech of a man is stored or recorded directly or after encoding into a waveform, with words or paragraphs as units, so as to be read out and edited by suitable interconnection to synthesize speech whenever necessity arises.

With the parametric synthesis system, the waveform of a speech of a man is previously analyzed, with the words or paragraphs as units, as in the case of the speech editing system, based on a speech synthesis model, so as to be stored in the form of a time sequence of parameters, and a speech synthesizer is driven, whenever necessity arises, using the time sequence of interconnected parameters, for synthesizing speech. Finally, with the rule synthesis method, a series of speech signals, expressed as discrete symbols such as letters or speech symbols, are converted continuously. During the process of conversion, generally applicable properties and artificial properties of speech synthesis are utilized as the rules of synthesis.

The above recited synthesis systems simulate the acoustic canal in some form or other to produce synthetic sound using signals having substantially the same characteristics as those of the source sound wave.

Up to now, in achieving high-quality control in speech analysis/synthesis, a residual-driving type analysis/synthesis system has frequently been utilized. However, the residual driving type synthesis/analysis system is not satisfactory in separating sound source information from auditory canal information and hence is subject to spectral distortion at the time of pitch change to lead to deterioration of the synthetic sound.

OBJECT AND SUMMARY OF THE INVENTION

In view of the above-depicted status of the art, it is an object of the present invention to provide a speech analysis/synthesis method whereby spectral distortion at the time of pitch change may be diminished to enable generation of the synthetic speech having a superior sound quality.

In one aspect of the present invention, the pulse train as a sound source information is set so that its period corresponds to the pitch period of speech signals on the time scale of the speech signals being analyzed. A difference between the phase information of the pulse train and the phase information of the speech signal being analyzed is found and is employed as the phase information of the desired one-pitch period. The phase information and the amplitude information are employed as data of the desired one-pitch period.

In another aspect of the present invention, the pulse train which is to be the sound source information is set so that its pitch corresponds to the pitch period of the speech signals on the time scale of the speech signals being analyzed and a difference between the phase information of the pulse train and the phase information of the speech signals being analyzed is found, which difference is used as the phase information for the desired one-pitch period within the speech signals being analyzed. On the other hand, the cepstrum of the speech signals being analyzed is found from the spectral envelope component obtained by fast Fourier transforming the speech signals being analyzed and the low-order component within the one-pitch period of the cepstrum is segmented. The spectral envelope component for the one-pitch period, as found from the low-order component, and the phase component, are fast Fourier transformed to find the impulse response for the one-pitch period, which impulse response is employed as the desired one-pitch period data.

According to the present method for speech analysis, not only the amplitude data but also the phase data are stored as the auditory canal information of the speech signals, while spectral envelope information and the phase information are also stored as the auditory canal information of the speech signals.

Other objects and advantages of the present invention will become clearer from the following description of the preferred embodiments and the claims.

DETAILED DESCRIPTION OF THE PREFERRED EMBODIMENTS

Figure 1:
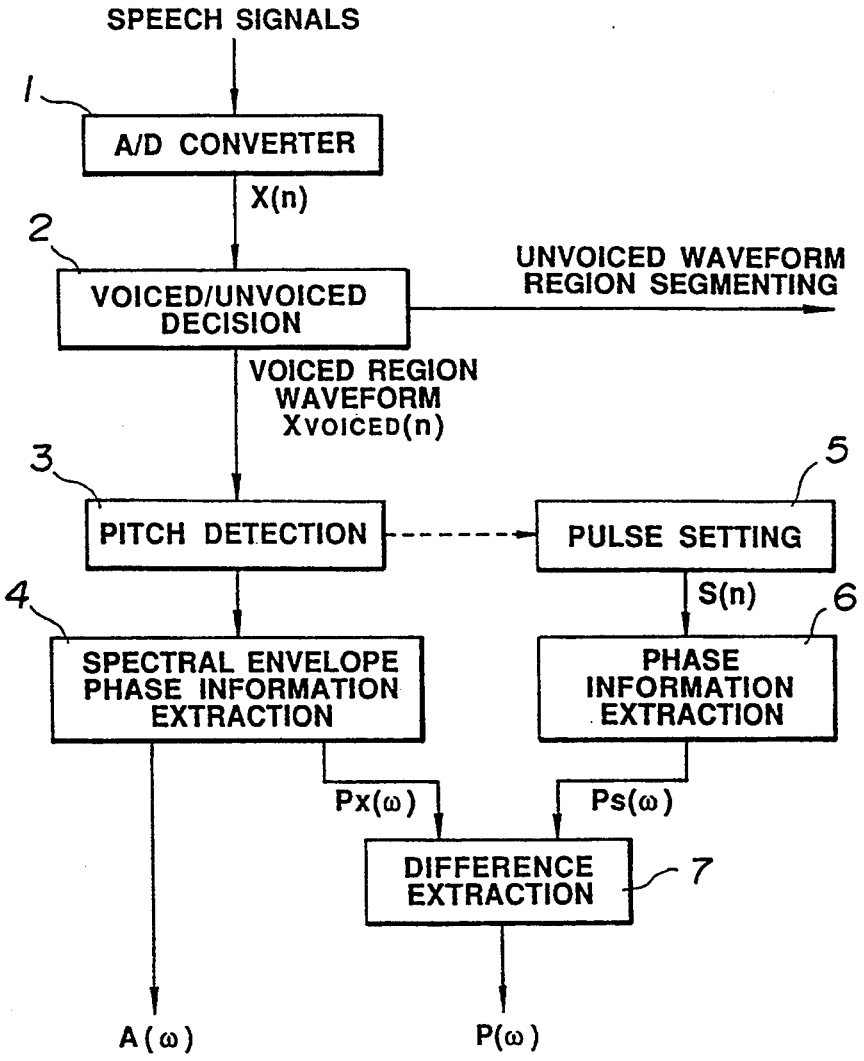
FIG. 1 is a block diagram showing a constitution of a system for executing the speech analysis method according to the present invention.

With the present speech analysis method, phase data for a desired one-pitch period is produced by a system shown in FIG. 1.

That is, with the system shown in FIG. 1, speech signals to be analyzed are supplied via analog/digital (A/D) converter 1 to a voiced/unvoiced discriminating unit 2.

The voiced/unvoiced discriminating unit 2 separates speech signals X(n), digitized by the A/D converter 1, into voiced speech segments and unvoiced speech segments. The unvoiced speech segments, separated by the voiced/unvoiced discriminating unit 2, are directly segmented as waveform sections which are stored as data.

First, the pitch period is found of the voiced speech segment $X_{voiced}$, as separated by the voiced/unvoiced discriminating unit 2, by a pitch detection unit 3 in accordance with an auto-correlation method. Besides, a spectral envelope component $A(\omega)$ and a phase component $P_X(\omega)$ are found of the voiced speech segment $X_{voiced}(n)$ by a spectral envelope/phase information extracting unit 4 in accordance with fast Fourier transform (FFT). The phase component $P_X(\omega)$ is found in an amount equivalent to one pitch period of the waveform being analyzed.

Besides the waveform being analyzed, a pulse train S(n) is set in a pulse setting unit 5, using the pitch period as found by the pitch detection unit 3, so that the pitch period of the pulse train corresponds to that of the waveform being analyzed on the time scale. A phase component $P_S(\omega)$ is found of the pulse train S(n) by the phase information extraction unit 5 in accordance with fast Fourier transform (FFT).

A difference $P(\omega)$ between the phase component $P_X(\omega)$ of the waveform being analyzed and the phase component $P_S(\omega)$ of the pulse train S(n), that is, $P(\omega)=P_X(\omega)-P_S(\omega)$, is found in a difference extraction unit 7 and outputted as a phase component of the speech waveform of the desired pitch period, along with the spectral envelope component, as results of analysis.

That is, with the present first embodiment, the pulse train S(n) as a sound source information is set so that its period corresponds to the pitch period of speech signals on the time scale of the speech signals being analyzed. A difference $P(\omega)$ between the phase information $P_S(\omega)$ of the pulse train S(n) and the phase information $P_X(\omega)$ of the speech signal being analyzed is found by $P(\omega)=P_X(\omega)-P_S(\omega)$ and is employed as the phase information of the desired one-pitch period. The phase information and the amplitude information are employed as data of the desired one-pitch period.

Since there is no dropout of the phase information of the speech signals during analysis of the speech signals, it becomes possible to execute significant pitch changes during speech synthesis from the stored information without deteriorating the sound quality. Besides, since the sound source information is a pulse train, distortion of the speech signal spectrum may be significantly diminished even when the pitch is changed by changing the period of the pulse train during speech synthesis from the stored information.

Figure 2:
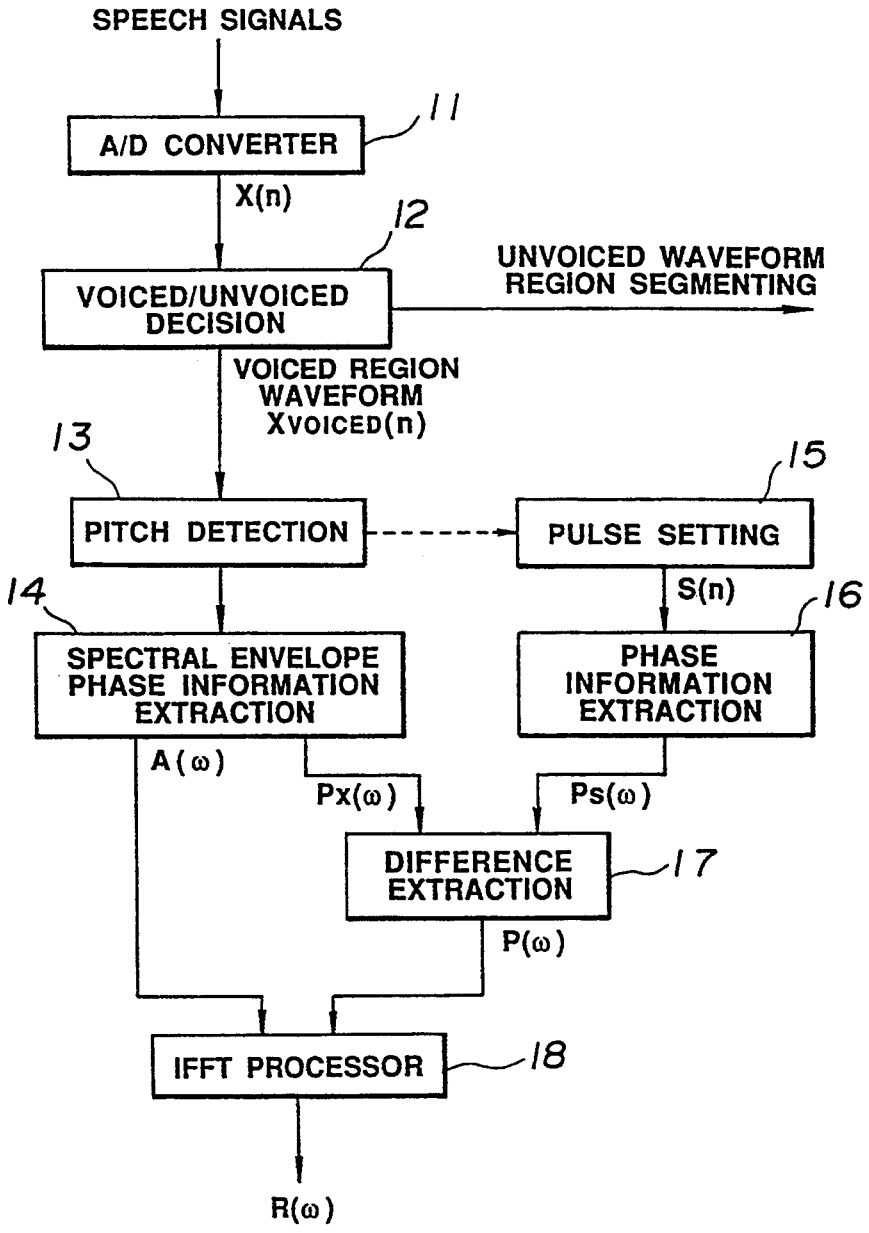
FIG. 2 is a block diagram showing another constitution of a system for executing the speech analysis method according to the present invention.
Figure 3:
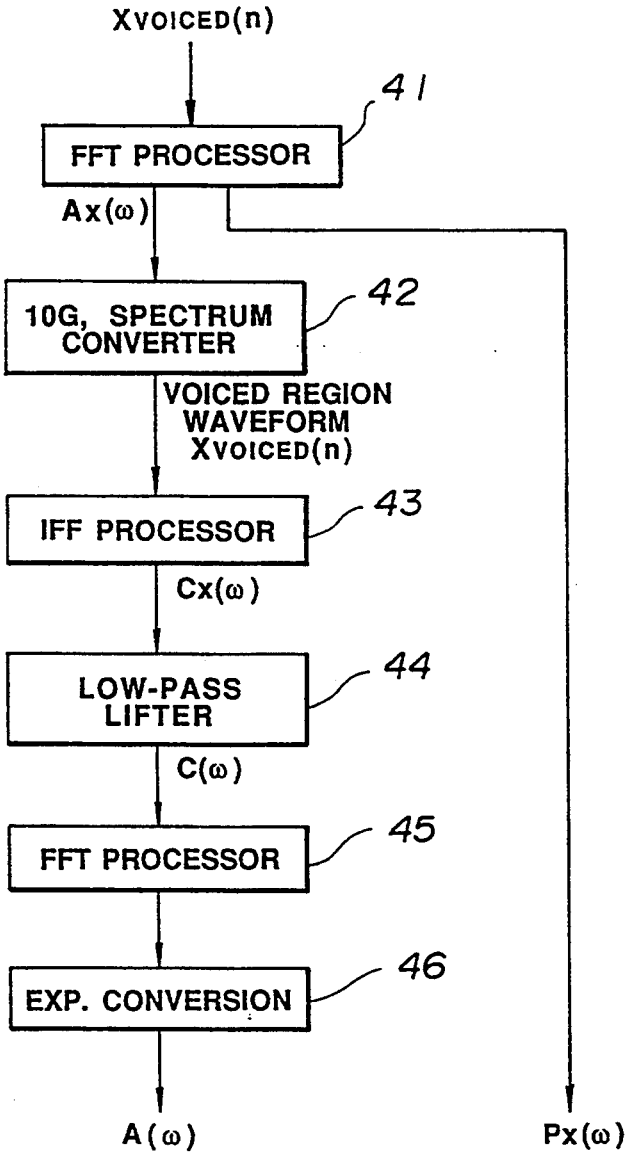
FIG. 3 is a block diagram showing a concrete constitution of a spectrum envelope/phase information detection unit constituting the system shown in FIG. 2.
Figure 4:
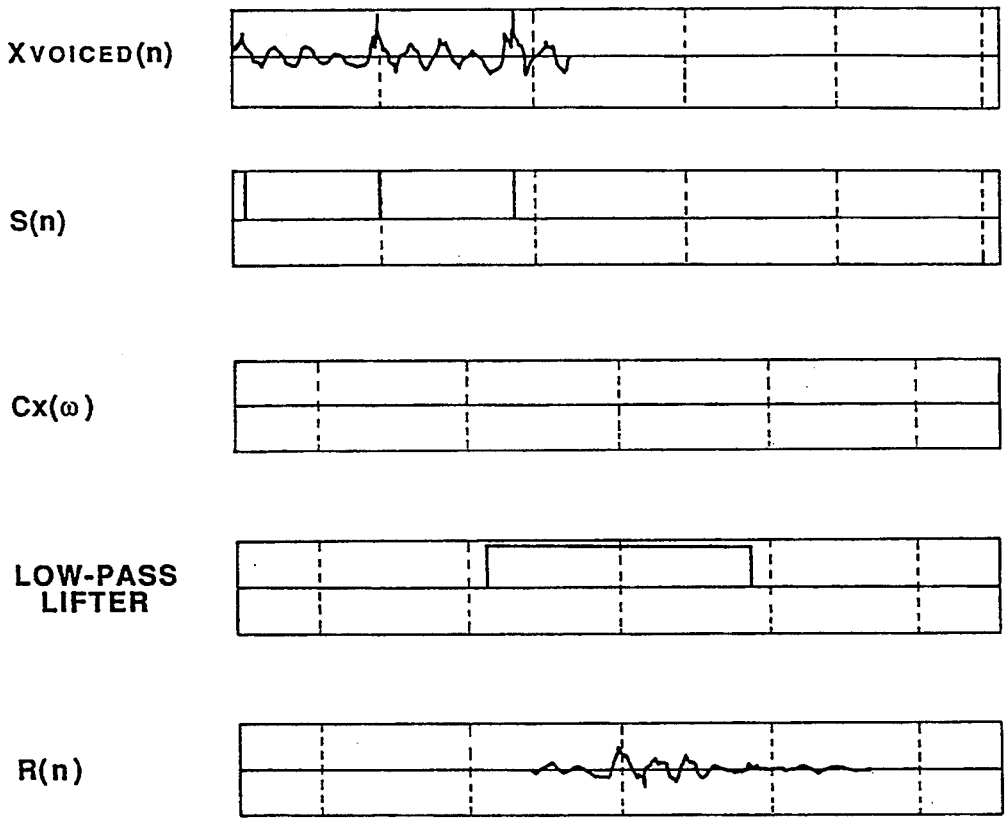
FIG. 4 is a signal waveform diagram for illustrating the operation of the system shown in FIG. 2.

Referring to FIGS. 2 to 4, the speech analysis method according to a second embodiment of the present invention is explained in detail.

With the present second embodiment, speech signals to be analyzed are supplied via an analog/digital (A/D) converter 11 to a voiced/unvoiced discriminating unit 12, as shown in FIG. 2.

The voiced/unvoiced discriminating unit 12 separates speech signals X(n), converted into digital signals by A/D converter 11, into voiced speech segments and unvoiced speech segments. The unvoiced speech segments, separated by the voiced/unvoiced discriminating unit 12, are directly segmented as waveform sections which are stored as data.

First, the pitch period is found of the voiced speech segment $X_{voiced}$, as separated by the voiced/unvoiced discriminating unit 12, by a pitch detection unit 13 in accordance with an auto-correlation method. Besides, a spectral envelope component $A(\omega)$ and a phase component $P_X(\omega)$ are found of the voiced speech segment $X_{voiced}(n)$ by a spectral envelope/phase information extracting unit 14.

In the present second embodiment, the spectral envelope/phase information extracting unit 14 finds the spectral envelope component $A_X(\omega)$ and the phase component $P_X(\omega)$ by FFT of the voiced speech segment $X_{voiced}(n)$ by a first FFT unit 41, as shown in FIG. 3. The phase component $P_X(\omega)$, produced by the FFT unit 41, is directly outputted as extracted phase information output.

The spectral envelope component $A_X(\omega)$, produced by the FFT unit 41, is logarithmically transformed at a logarithmic transform unit 42 and inverse fast Fourier transformed by IFFT unit 43. In this manner, a cepstrum $C_X(\omega)$ of the speech signals being analyzed is found, as shown in FIG. 4. The low-order cepstrum $C(\omega)$ within a one-pitch period is extracted from the cepstrum $C_X(\omega)$ by a low-pass lifter 44. This low-order cepstrum $C_X(\omega)$ is processed with FFT by a second FFT unit 45 and exponentially transformed in an exponential transform unit 46. In this manner, a spectral envelope component $A(\omega)$ of the desired one-pitch period is found. The spectral envelope component $A(\omega)$, produced by the exponential transform unit 46, becomes the extracted spectral envelope information output.

Besides the waveform being analyzed, a pulse train S(n) is set in a pulse setting unit 15, using the pitch period as found by the pitch detection unit 13, so that the pitch period of the pulse train corresponds to that of the waveform being analyzed on the time scale. A phase component $P_S(\omega)$ is found of the pulse train S(n) by the phase information extraction unit 16 in accordance with fast Fourier transform (FFT).

A difference $P(\omega)$ between the phase component $P_X(\omega)$ of the waveform being analyzed and the phase component $P_S(\omega)$ of the pulse train S(n), that is, $P(\omega)=P_X(\omega)-P_S(\omega)$, is found in a difference extraction unit 17 and outputted as a phase component of the impulse response for a desired one pitch of the spectral envelope component $A(\omega)$.

The spectral envelope component $A(\omega)$ and the phase component $P(\omega)$ are processed with IFFT by an IFFT unit 18 to find an impulse response $R(\omega)$ for the desired one pitch which is outputted as a result of analyses.

That is, with the present second embodiment, the pulse train S(n) which is to be the sound source information is set so that its pitch corresponds to the pitch period of the speech signals on the time scale of the speech signals being analyzed and a difference $P(\omega)$ between the phase information $P_S(\omega)$ of the pulse train S(n) and the phase information $P_X(\omega)$ of the speech signals being analyzed X(n) is found by $P(\omega)=P_X(\omega)-P_S(\omega)$ is found, which difference $P(\omega)$ is used as the phase information for the desired one-pitch period within the speech signals being analyzed. On the other hand, the cepstrum $C_X(\omega)$ of the speech signals being analyzed X(n) is found from the spectral envelope component $A(\omega)$ obtained by fast Fourier transforming the speech signals being analyzed and the low-order component $C(\omega)$ within the one-pitch period of the cepstrum $C_X(\omega)$ is segmented from the cepstrum $C_X(\omega)$. The spectral envelope component $A(\omega)$ for the one-pitch period, as found from the low-order component $C(\omega)$, and the phase component $P(\omega)$, are fast Fourier transformed to find the impulse response $R(\omega)$ for the one-pitch period, which impulse response $R(\omega)$ is employed as the desired one-pitch period data.

In the present second embodiment, similarly to the preceding embodiment, since there is no dropout of the phase information of the speech signals during analysis of the speech signals, it becomes possible to execute significant pitch change during speech synthesis from the stored information without deteriorating the sound quality. In addition, since the sound source information is a pulse train, distortion of the spectrum of the speech signals may be significantly diminished even when the pitch is changed by changing the period of the pulse train during speech synthesis from the stored information.

What is claimed is:

1. A method of speech analysis for supplying data of a desired one-pitch period within input speech signals to synthesize speech with diminished spectral distortion at a time of pitch change, comprising the steps of:

discriminating voiced segments and unvoiced segments of said input speech signals;

detecting a pitch period of said input speech signals using said voiced segments;

extracting a phase information and a spectral envelope information from said voiced segments of said input speech signals;

generating a pulse train as a sound source information on a time scale of said input speech signals, said pulse train having a pitch period corresponding to said pitch period detected from said voiced segments of said input speech signals;

extracting a phase information of said pulse train;

finding a difference between said phase information of said pulse train and said phase information of said voiced segments of said input speech signals, wherein said difference is a phase information for said desired one-pitch period within said input speech signals; and supplying said difference representing said phase information for said desired one-pitch period as well as said spectral envelope information extracted from said voiced segments of said input speech signals as said data of said desired one-pitch period.

2. A method of speech analysis for supplying data of a desired one-pitch period within input speech signals to synthesize speech with diminished spectral distortion at a time of pitch change, comprising the steps of;

discriminating voiced segments and unvoiced segments of said input speech signals;

detecting a pitch period of said input speech signals using said voiced segments;

extracting a phase information from said voiced segments of said input speech signals;

generating a pulse train as a sound source information on a time scale of said input speech signals, said pulse train having a pitch period corresponding to said pitch period detected from said voiced segments of said input speech signals;

extracting a phase information of said pulse train;

finding a difference between said phase information of said pulse train and said phase information of said input speech signals, said difference representing a phase information for said desired one-pitch period within said input speech signals;

generating a cepstrum by fast Fourier transforming said voiced segments of said input speech signals to find a spectral component and performing a logarithmic transform followed by an Inverse Fast Fourier Transform on said spectral component;

extracting a spectral information for a one-pitch period by segmenting low-order components of said cepstrum within said one-pitch period;

generating an impulse response for said one-pitch period by inverse fast Fourier transforming said spectral information, along with said difference representing said phase information for said desired one-pitch period within said input speech signals; and supplying said impulse response as said data for said desired one-pitch period.

3. A speech analysis device for supplying data of a desired one-pitch period within input speech signals to synthesize speech with diminished spectral distortion at a time of pitch change, comprising;

means for discriminating voiced segments and unvoiced segments of said input speech signals;

pitch detecting means for detecting a pitch period of said input speech signals using said voiced segments and outputting said detected pitch period;

means for extracting a phase information and an amplitude information from said voiced segments of said input speech signals;

means for generating a pulse train as a sound source information on a time scale of said input speech signals so that a pitch period of said pulse train corresponds to said detected pitch period of said input speech signals output by said pitch detecting means; and means for extracting a phase information of said pulse train;

means for finding a difference between said phase information of said pulse train and said phase information of said input speech signals, wherein said difference representing a phase information for said desired one-pitch period within said input speech signals, as well as said amplitude information is supplied as said data of said desired one-pitch period.

4. A speech analysis device for supplying data of a desired one-pitch period within input speech signals to synthesize speech with diminished spectral distortion at the time of pitch change, comprising;

means for discriminating voiced segments and unvoiced segments of said input speech signals;

pitch detecting means for detecting a pitch period of said input speech signals using said voiced segments and outputting said detected pitch period;

means for extracting a phase information from said voiced segments of said input speech signals;

means for generating a pulse train as a sound source information on a time scale of said input speech signals so that a pitch period of said pulse train corresponds to said detected pitch period of said input speech signals output by said pitch detecting means;

means for extracting a phase information of said pulse train;

means for finding a difference between said phase information of said pulse train and said phase information of said voiced segments of said input speech signals, said difference representing a phase information for said desired one-pitch period within said input speech signals;

means for generating a cepstrum of said voiced segments of said input speech signals, including means for performing a Fast Fourier Transform on said voiced segments of said input speech signals to extract a spectral component of said voiced segments of said input speech signals;

means for segmenting low-order components of said cepstrum within a one-pitch period to find a spectral information for said one-pitch period; and means for generating an impulse response for said one-pitch period, including means for performing an Inverse Fast Fourier Transform on said spectral information along with said phase information extracted from voiced segments of said input speech signals, wherein said impulse response is supplied as said data for said desired one-pitch period.

5. A speech analysis device for supplying data of a desired one-pitch period within input speech signals to synthesize speech with diminished spectral distortion at the time of pitch change, comprising:

an analog-to-digital converter for converting said input speech signals from analog to digital and supplying digital speech signals;

means for discriminating voiced segments and unvoiced segments of said digital speech signals supplied by said analog-to-digital converter;

pitch detecting means for detecting a pitch period of said input speech signals using said discriminated voiced segments;

envelope/phase information extracting means for finding and extracting spectral envelope component information and phase component information from said voiced segments of said input speech signals;

means for generating a pulse train having a pitch period corresponding on a time scale to said pitch period detected by said pitch detecting means from said voiced segments of said input speech signals;

phase information extracting means for finding and extracting a phase component of said pulse train; and difference extracting means for finding and outputting a difference between said phase component extracted by said envelope/phase information extracting means and said phase component of said pulse train extracted by said phase information extracting means, wherein said difference outputted by said difference extracting means as a phase component along with said spectral envelope component outputted by said envelope/phase information extracting means are supplied as said data of said desired one-pitch period within said input speech signals.

6. A speech analysis device for supplying data of a desired one-pitch period within input speech signals to synthesize speech with diminished spectral distortion at the time of pitch change, comprising:

an analog to digital converter for converting input speech signals from analog to digital and supplying digital speech signals;

means for discriminating voiced segments and unvoiced segments of said digital speech signals supplied by said analog-to-digital converter;

pitch detecting means for detecting a pitch period of said input speech signals using said discriminated voiced segments;

envelope/phase information extracting means for finding and extracting spectral envelope component information and phase component information from said voiced segments of said input speech signals;

means for generating a pulse train having a pitch period corresponding on a time scale to said pitch period detected by said pitch detecting means from said voiced segments of said input speech signals;

phase information extracting means for finding and extracting a phase component of said pulse train;

difference extracting means for finding and outputting a difference between said phase component extracted by said envelope/phase information extracting means and said phase component of said pulse train extracted by said phase information extracting means, said difference representing a phase component of an impulse response for a desired one pitch of said spectral envelope component extracted by said envelope/phase information extracting means; and inverse fast Fourier transforming means for finding said impulse response for said desired one pitch using both said spectral envelope component extracted by said envelope/phase information extracting means and said difference output by said difference extracting means and outputting said impulse response.

7. The speech analysis device as claimed in claim 5 wherein processing by said envelope/phase information extracting means and said phase information extracting means is by Fast Fourier Transform.

8. The speech analysis device as claimed in claims 5 or 6 wherein the phase component extracted by said envelope/phase information extracting means corresponds to a one-pitch period of said input speech signals.

9. The speech analysis device as claimed in claims 5 or 6 wherein said pitch detecting means finds the pitch period by an auto-correlation method.

* * * * *